United States Patent [19]

Mizutani

[11] Patent Number: 5,069,435

[45] Date of Patent: Dec. 3, 1991

[54] SHEET STACKER HAVING SHEET-FEED FUNCTION

[75] Inventor: Minoru Mizutani, Tokyo, Japan

[73] Assignee: Oki Electric Industry Co., Ltd., Tokyo, Japan

[21] Appl. No.: 582,190

[22] PCT Filed: Jan. 18, 1990

[86] PCT No.: PCT/JP90/00049

§ 371 Date: Sep. 24, 1990

§ 102(e) Date: Sep. 24, 1990

[87] PCT Pub. No.: WO90/08656

PCT Pub. Date: Aug. 9, 1990

[30] Foreign Application Priority Data

Jan. 25, 1989 [JP] Japan ..... 1-7106

[51] Int. Cl.[5] ..... B65H 3/44

[52] U.S. Cl. ..... 271/3; 271/9; 400/625

[58] Field of Search ..... 271/3, 9, 145; 400/624, 400/625

[56] References Cited

U.S. PATENT DOCUMENTS 4,475,731 10/1984 Wood ..... 271/9
4,645,192 2/1987 Watanabe ..... 271/9
4,789,258 12/1988 Gomoll ..... 271/9 X

*Primary Examiner*—Richard A. Schacher
*Attorney, Agent, or Firm*—Wenderoth, Lind & Ponack

[57] ABSTRACT

A stacker having a hand-feed function is to be used in combination with a printer and enables the hand feed of a cut sheet even if the cut sheet is comparatively short, without being obstructed by printed cut sheets stacked on the stacker. The stacker has a flat hand-feed chute formed of a front plate, a back plate and opposite side plates and is provided with sheet guides each having an inclined side or section inclined upwardly with respect to an direction of delivery of printed cut sheets and set upright on the upper surface of the front plate. An upper portion of the front plate is cut or recessed to form a hand-feed opening.

3 Claims, 2 Drawing Sheets

SHEET STACKER HAVING SHEET-FEED FUNCTION

DESCRIPTION

1. Technical Field

The present invention relates to a sheet stacker for use in combination with a printer to hold printing cut sheets, and having a hand-feed function.

2. Background of the Invention

A known printer is provided with an automatic cut sheet feeder, a printing unit, and a stacker disposed between the automatic cut sheets feeder and the printing unit to hold printed cut sheet, and allows feeding cut sheets by hand through a space behind the stacker to the printing unit. Japanese Patent Publication No. 63-53091 discloses a hand-feed construction having a fixed hand-feed chute formed by a slit between the backside and bottom of a stacker and capable of enabling hand feed when necessary. The hand-feed chute of this known hand-feed construction is blocked by a printed cut sheet delivered to the stacker after printing, and hence the printed cut sheet blocking the hand-feed chute must be removed when feeding a cut sheet by hand.

U.S. Pat. No. 4,253,652 discloses a sheet feeder intended to prevent blocking of a hand-feed chute by a printed cut sheet. This sheet feeder has a funnel-shaped hand-feed chute formed of a rear wall of a stacker and a guide plate disposed behind the stacker, and an auxiliary inserter is attached to the funnel-shaped hand-feed chute when necessary. The rear wall of the stacker has a sufficiently large height to prevent a printed cut sheet from blocking the hand-feed chute, and the rear wall of the stacker and the guide plate are disposed so as to form the hand-feed chute in the shape of a funnel. Since the inlet of the hand-feed chute is remote from the printing unit and the inlet is narrow, it is impossible to feed a cut sheet to the printing unit by holding the cut sheet when the cut sheet is short. Therefore, the cut sheet is dropped through the inlet into the hand-feed chute. However, when the cut sheet is curled or charged with static electricity, the leading edge of the cut sheet is unable to reach the printing unit properly, thus causing jamming and making printing impossible.

It is an object of the present invention to provide a stacker having a hand-feed function ensuring the hand-feed of a cut sheet to the printing unit regardless of the length of the cut sheet and without being obstructed by a printed cut sheet held therein.

SUMMARY OF THE INVENTION

In one aspect of the present invention, a stacker having a hand-feed function disposed between a printing unit and an automatic sheet feeder to hold printed cut sheets has a flat hand-feed chute formed of a front plate, an upper portion of the front plate being cut to form a hand-feed recess communicating with the hand-feed chute, a back plate and side plates, and sheet guides inclined upwardly with respect to a direction of delivery of printed cut sheets and attached to an upper surface of the front plate.

The stacker having a hand-feed function thus constructed guides printed cut sheets along the sheet guides to stack the printed cut sheets. Hence a space is formed between the front plate and the printed cut sheets to allow the hand feed of a cut sheet through the hand-feed chute without being obstructed by the printed cut sheets. Accordingly, printing efficiency is not reduced and ease of printing is improved remarkably.

The hand-feed recess formed by cutting the upper portion of the front plate reduces the distance between the hand-feed recess and the printing unit and hence a leading edge of a cut sheet can be inserted surely into the printing unit by hand regardless of the length of the cut sheet. Since the cut sheet can properly be inserted into the printing unit by hand, print quality is not deteriorated and maintenance is facilitated.

DETAILED DESCRIPTION OF THE INVENTION

The present invention will be described in further detail with reference to the accompanying drawings.

Figure 1:
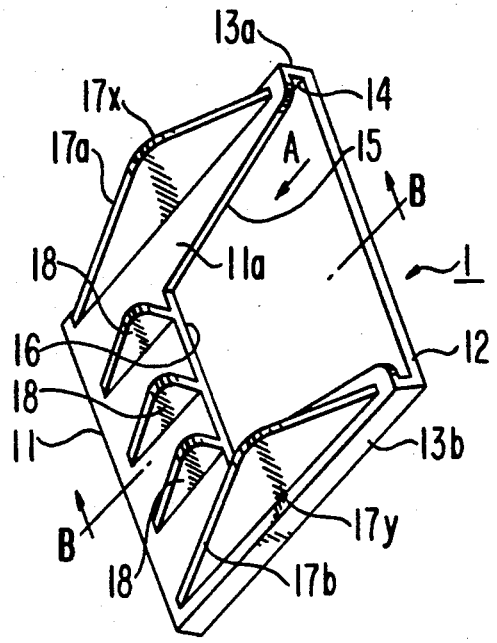
FIG. 1 is a perspective view of a stacker having a hand-feed function in a preferred embodiment according to the present invention.

FIG. 1 is a perspective view of a stacker having a hand-feed function in a preferred embodiment according to the present invention. The stacker 1 having a hand-feed function has a flat hand-feed chute 14 formed by positioning a front plate 11 and a back plate 12 with a predetermined distance therebetween and attaching side plates 13 to the opposite lateral ends of the front plate 11 and the back plate 12. An upper portion of the front plate 11 is cut to form a recess 15 serving as a hand-feed opening 16.

Side sheet guides 17*x* and 17*y* each having an inclined side inclined upwardly with respect to a direction of delivery of a printed cut sheet are disposed adjacent respective opposite sides of an upper surface 11*a* of the front plate 11. Intermediate sheet guides 18 each having an inclined side having the same inclination as that of the inclined sides of the side sheet guides 17*x* and 17*y* are arranged on the upper surface 11*a* of the front plate 11 between the side sheet guides 17*x* and 17*y*. The distance between the side sheet guides 17*x* and 17*y* corresponds to the width of cut sheets to be used by the printer.

The stacker 1 having a hand-feed function of such a construction is formed integrally of a synthetic resin or the like.

Figure 2:
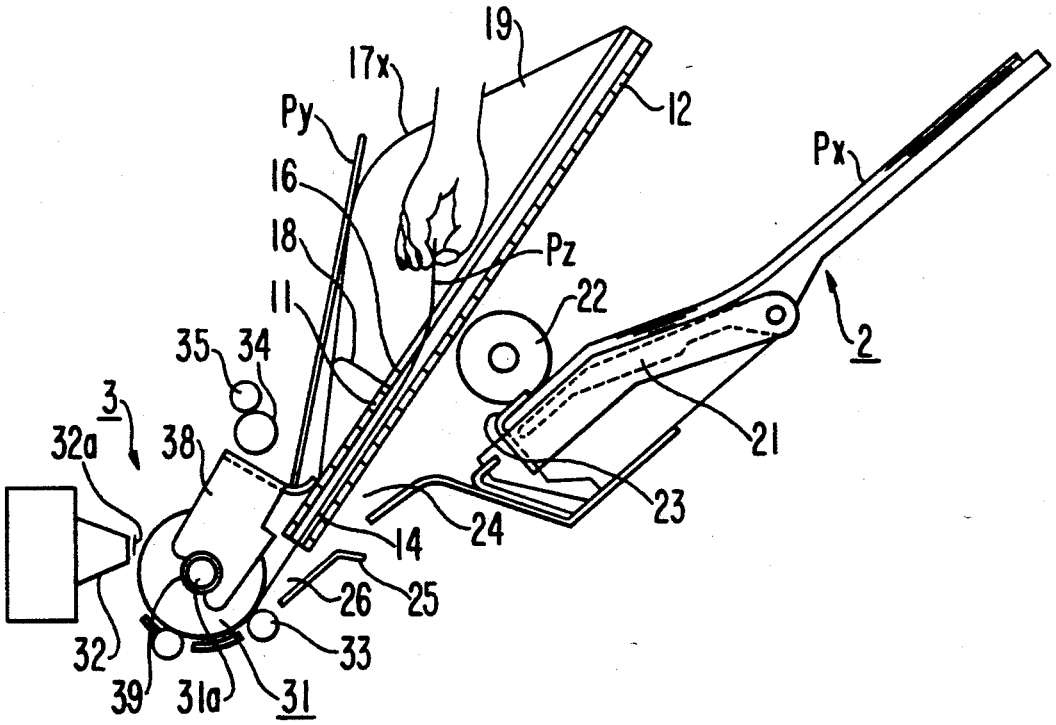
FIG. 2 is a fragmentary side elevation of the printing mechanism of a printer combined with the stacker having a hand-feed function in accordance with the present invention.
Figure 3:
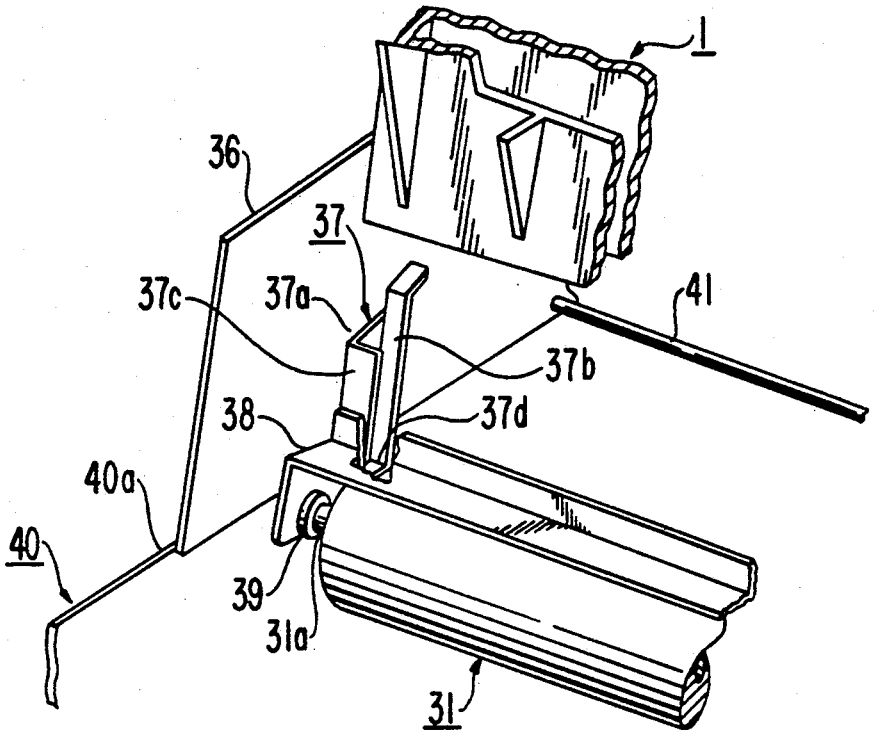
FIG. 3 is a fragmentary perspective view of a mounting unit of the stacker having a hand-feed function.
Figure 4:
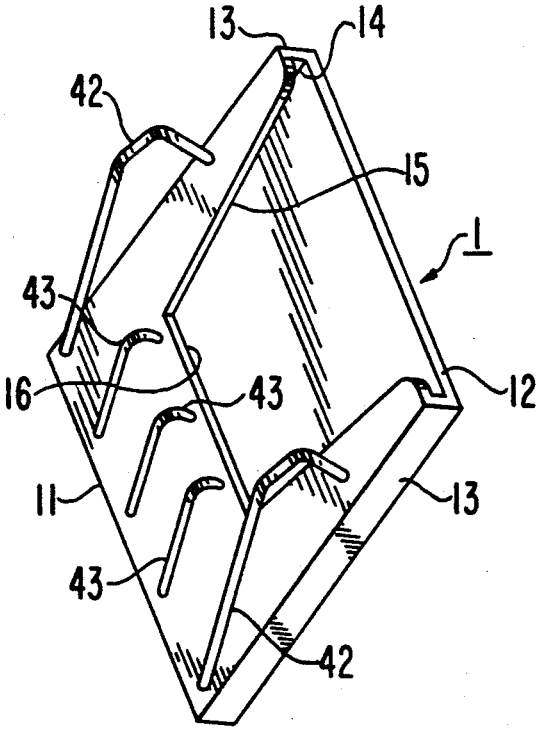
FIG. 4 is a perspective view of a modification of the stacker having a hand-feed function.

The sheet guides 17*x*, 17*y* and 18 may be replaced by guide members 42 and 43 formed by bending a metalic or resin wire in the external shapes of the sheet guides 17*x*, 17*y* and 18, as shown in FIG. 4, and the extremities of the guide members 42 and 43 may be inserted into the upper surface 11*a* of the front plate 11, or fastened thereto by threading onto the extremities of the guide members 42 and 43 from the interior surface of the front plate 11. FIG. 2 shows a printing mechanism of a printer equipped with the stacker having a hand-feed function in accordance with the present invention, in which the side plates, gears, motor, belts and stacker mounting members of the printer are omitted so that the essential portions of the printing mechanism may readily be understood. The section of FIG. 2 is taken along line B—B in FIG. 1. FIG. 3 is a fragmentary perspective view showing a printer side plate and the stacker mounting members, which are omitted from FIG. 2, in which the right-hand half of the stacker 1 and the right-hand side plate are omitted because the stacker 1 is symmetrical and the right-hand and left-hand side plates are disposed symmetrically with respect to the center line of the printer. The members and portions on the right-hand side will be denoted by the reference characters denoting those shown in FIG. 3. Referring to FIG. 2, the printing mechanism consists of the stacker 1 having a hand-feed function, an automatic sheet feeder 2 and a printing unit 3. The stacker 1 having a hand-feed function is disposed between the automatic sheet feeder 2 and the printing unit 3. As shown in FIG. 3, a platen 31 of the printing unit 3 is journaled in bushes 39 on the side frames 40 of the printer. A support member 38 rotatably holding the bushes 39 as shown in FIG. 2 is fastened to side plates 36 by welding or screwing. As shown in FIG. 2, the stacker 1 having a hand-feed function and the automatic sheet feeder 2 are mounted on the side plates 36 in that order from the platen 31 rearwardly. The support member 38 is fastened at its opposite ends to the side plates 36 to stabilize the side plates 36 and to receive lower edges of printed cut sheets. Stacker mounting members 37 are provided on the rear side of the support member 38 and are fastened to the side plates 36 by welding or the like. The stacker mounting members 37 are formed by bending sheet metal. Each stacker mounting member 37 has guide walls 37*b* and 37*c* slidable mating respectively with the back surface and front surface of the stacker 1, a bottom wall 37*d* on which the stacker 1 is seated, and a fixing wall 37*a* fastened to the side plate 36 by fastening means as welding. The automatic sheet feeder 2 has a pick up roller 22 (FIG. 2) journaled on the side plates 36, and a sheet feed unit 21 mounted on mounting members similar to the stacker mounting members 37. Pinch rollers 33, a stacker roller 34 and stacker pinch rollers 35 shown in FIG. 2 are journaled on the side plates 36. A support member 41 is extended between the lower rear portions of the side plates 36 to stabilize the side plates 36. The opposite ends of the support member 41 penetrating the side plates 36 rest respectively on upper sides 40*a* of the side frames 40 of the printer. Thus, the support members 38 and 41 rest on the side frames 40 of the printer when the side plates 36 are mounted on the printer.

The automatic sheet feeder 2 holds a plurality of cut sheets $P_x$ therein. The cut sheets $P_x$ are fed one at a time by the pickup roller 22 and fingers 23 of the sheet feed unit 21. A cut sheet $P_x$ fed through a sheet feed gap 24 is guided by a guide plate 25 to a sheet insertion gap 26. In a sheet insertion gap 26, the leading edge of the cut sheet $P_x$ is advanced to the platen 31 by the pinch rollers 33 so that the cut sheet $P_x$ will wrap around the platen 31. The platen 31 is rotated synchronously with the pickup roller 22 through gears, belts, chains or the like. The cut sheet Px is printed through an ink ribbon 32*a* by a print head 32, line by line. After a line is completed, the cut sheet Px is advanced by rotating the platen 31. Then, another line is printed. After the completion of printing on the cut sheet $P_x$, the printed cut sheet $P_y$ is delivered toward the front plate 11 of the stacker 1 by the stacker roller 34 and the stacker pinch rollers 35. After the printed cut sheet $P_y$ has been discharged from the printing unit, the next cut sheet $P_x$ is fed to the platen 31 and is wound around the platen 31. Then, the same printing cycle is executed. The printed cut sheets $P_y$ delivered to the stacker 1 are stacked in a pile on the respective inclined sides 17*a* and 17*b* of the pair of side sheet guides 17*x* and 17*y*. Therefore, a space 19 is formed between the pile of the printed cut sheets $P_y$ and the front plate 11, and hence between the pile of the printed cut sheets $P_y$ and the hand-feed opening 16.

When it is desired to subject a cut sheet $P_z$ having a size and a shape different from cut sheets $P_x$ to printing in the printing unit 3, the cut sheet $P_z$ can be inserted by hand through the space 19 into the hand-feed opening 16. Since the space 19 has a thickness corresponding to the height of the side sheet guides 17*x* and 17*y*, the cut sheet $P_z$ can easily be inserted into the hand-feed opening 16 by hand so that the leading edge of the hand-fed cut sheet $P_z$ is surely pinched between the platen 31 and the pinch rollers 33 and is surely fed through the hand-feed chute 14 even if the hand-fed cut sheet $P_z$ is curled or charged with static electricity or the hand-fed cut sheet $P_z$ is as thick as an envelope. The hand-fed cut sheet $P_z$, similarly to the cut sheet $P_x$, is wound around the platen 31, is printed by the printing head 32, and is delivered as a printed cut sheet $P_y$ onto the side sheet guides 17*x* and 17*y* or onto the intermediate sheet guides 18.

In case the hand-feed chute 14 is clogged by the hand-fed cut sheet $P_z$, the hand-fed cut sheet $P_z$ can readily be removed because the distance between the hand-feed opening 16 and the printing unit 3 is short.

Thus, the stacker having a sheet feed function in accordance with the present invention incorporated into the printing mechanism enables printing on a hand-fed cut sheet in a continuous printing process in which cut sheets are fed automatically.

As is apparent from the foregoing description, a stacker having a sheet feed function in accordance with the present invention is used in combination with a printer which uses cut sheets and is able to operate in a hand-feed mode. The stacker is disposed between an automatic sheet feeder storing a plurality of cut sheets and a printing unit. When it is desired to hand-feed a cut sheet during a printing operation in which cut sheets are fed automatically by the automatic sheet feeder, the automatic sheet feed operation is interrupted and a cut sheet is fed through a space behind the stacker.

I claim:

1. A stacker having a hand-feed function disposed between the printing unit and automatic sheet feeding of a printer to store printed cut sheets, said stacker comprising:

a flat hand-feed chute formed of a front plate, a back plate, and opposite side plates; and sheet guide members each having an inclined side inclined upwardly with respect to a direction of delivery of printed cut sheets and set upright on an upper surface of said front plate;

an upper portion of said front plate being cut away to form a hand-feed opening communicating with the interior of said hand-feed chute.

2. A stacker having a hand-feed function according to claim 1, wherein said sheet guide members are plate members each having an inclined side inclined upwardly with respect to the direction of delivery of printed cut sheets.

3. A stacker having a hand-feed function according to claim 1, wherein said sheet guide members are wire members each formed by bending a wire and having an inclined section inclined upwardly with respect to the direction of delivery of printed cut sheets.

* * * * *